United States Patent [19]

Wakamatsu et al.

[11] 4,418,539

[45] Dec. 6, 1983

[54] METHOD AND SYSTEM FOR CONTROLLING THE START OF A THERMAL POWER PLANT

[75] Inventors: Hidekazu Wakamatsu, Kodaira; Yoichiro Kogure, Tama, both of Japan

[73] Assignee: Tokyo Shibaura Denki Kabushiki Kaisha, Kawasaki, Japan

[21] Appl. No.: 336,704

[22] Filed: Jan. 4, 1982

[30] Foreign Application Priority Data

Jan. 14, 1981 [JP] Japan ..... 56-3238

[51] Int. Cl.[3] ..... F01K 13/02

[52] U.S. Cl. ..... 60/646; 60/664; 60/667

[58] Field of Search ..... 60/646, 664, 667

[56] References Cited

U.S. PATENT DOCUMENTS 4,121,424 10/1978 Sato et al. ..... 60/646

4,213,304 7/1980 Morse ..... 60/667 X

*Primary Examiner*—Allen M. Ostrager

*Attorney, Agent, or Firm*—Oblon, Fisher, Spivak, McClelland & Maier

[57] ABSTRACT

A method of controlling the start of a thermal power plant having a turbine, a boiler for generating superheated steam to drive the turbine, a fuel source for supplying fuel to the boiler, fuel supply controller for controlling the fuel supply from the fuel source to the boiler, and the like. The method includes a step for calculating a desired temperature of combustion gas in the boiler and, in addition, a step of feeding a process factor indicative of the start mode of the turbine. Hence the temperature of combustion gas in the boiler is controlled according not only to the start condition of the boiler but also to the start condition of the turbine, thus reducing the time necessary to start the thermal power plant.

10 Claims, 8 Drawing Figures

METHOD AND SYSTEM FOR CONTROLLING THE START OF A THERMAL POWER PLANT

BACKGROUND OF THE INVENTION

This invention relates to a method and system for controlling the start of a thermal power plant.

A thermal power plant has various systems such as a boiler system, a turbine system and a generator system. To start the plant, every system must made ready to operate. In the boiler system, for example, a fuel supply system is operated under the control of a fuel supply controller, a burner is then ignited, and the temperature and pressure of the water flowing through water-wall tube of the boiler are gradually raised. In the turbine system, a condenser is increasingly evacuated to such extent that superheated steam may be led into a turbine. When the steam is heated to such a temperature that so-called mismatch temperature, i.e. a difference between the temperature of the steam at the outlet of the first-stage steam chamber of the turbine and the temperature of an inner metal wall of the first-stage steam chamber, falls into a permissible range, the steam is supplied to the turbine. Then, the turbine starts rotating. The speed of the turbine is elevated until the turbine provides a rated output.

Hitherto, the temperature and pressure of superheated steam has been regulated by controlling the temperature and pressure of the water flowing through water-wall tube of the boiler in accordance with only the condition of heat-exchanging in a superheater and the start condition of the boiler, regardless the operation factors of the turbine. The steam in the boiler is gradually heated as heat-exchanging is effected by the superheater, no matter whether the power plant is started in so-called "boiler hot" mode or so-called "turbine cold" mode. In some cases the temperature of the superheated steam is so high that the mismatch temperature falls out of said permissible range. This is because the steam can be heated in a short time to such temperature that the mismatch temperature falls within the permissible range in case the power plant is started in boiler hot mode and the boiler is thus hot from the beginning. And this is because the temperature of steam which makes the mismatch temperature fall within the permissible range is low in case the power plant is started in turbine cold mode. If the temperature of the superheated steam is too high, it must be lowered until the mismatch temperature falls into the permisslbe range. This means that it takes a long time to start the power plant. If superheated steam of an excessively high temperature is supplied to the turbine, the rotor and other metal parts of the turbine will be heated so abruptly that an extremely large thermal stress is applied on the rotor. This would reduce the life of the turbine. Thus it is necessary to lessen the thermal stress on the rotor. To achieve this various measures are taken until the rotor rotates fast enough to provide a rated output. For example, the speed of turbine is adjusted or the load on the turbine is regulated.

As mentioned above, in the conventional method for controlling the start of a thermal power plant it takes a long time to start the plant since the start of the plant is not controlled according to the start mode, the boiler hot mode or the turbine cold mode.

Indeed with the conventional power supply system it does not matter if the start of the thermal power plant is delayed by some time. Recently, an emergency shut-down may take place often in nuclear power plants which are being built in increasing numbers. It is therefore increasingly demanded that thermal power plants be started as soon as possible in case an emergency shut-down occurs in the nuclear power plants.

SUMMARY OF THE INVENTION

Accordingly it is an object of the present invention to provide a method and system for controlling the start of a thermal power plant, which can start the power plant very quickly.

According to the invention there is provided a method for controlling the start of a thermal power plant having a turbine, a boiler for generating superheated steam to drive the turbine, a fuel source for supplying fuel to the boiler, a fuel supply controller for controlling the fuel supply from the fuel source to the boiler, and the like, said method comprising the steps of: supplying fuel from the fuel source to the boiler after the plant has been prepared to start; igniting burners of the boiler thereby to raise the temperature and pressure of water flowing through the water-wall tube of the boiler; causing the fuel supply controller to control the fuel supply to the boiler; and starting the supply of superheated steam from the boiler to the turbine when the superheated steam reaches a temperature which satisfies a condition for starting the turbine, said step of causing the fuel supply controller to control the fuel supply including a step of calculating a desired temperature of combustion gas in the boiler from a process factor indicative of the start mode of the turbine, a step of calculating a process quantity of the fuel supply controller from a difference between the desired temperature of combustion gas calculated and the temperature of the combustion gas detected in the boiler, and a step of operating the fuel supply controller according to the process quantity calculated, thereby controlling the fuel supply from the fuel source to the boiler.

Further, according to the invention there is provided a system for controlling the start of a thermal power plant having a turbine, a boiler for generating superheated steam to drive the turbine, a fuel source for supplying fuel to the boiler, and the like, said system comprising: temperature control means for controlling the temperature of superheated steam from the boiler according to the process factor indicative of the start mode of the turbine, thereby to control the fuel supply from the fuel source to the boiler, said temperature control means including means for calculating a desired temperature of combustion gas in the boiler according to the process factor and means for calculating a process quantity for controlling the fuel supply from a difference between the desired temperature of combustion gas and the temperature of the combustion gas in the boiler; and a fuel supply control means for controlling the fuel supply from the fuel source to the boiler according to the process quantity calculated by said temperature control means.

In the method and system according to the present invention a process factor indicative of the start mode of the turbine is given by detecting the temperature of a metal wall of the first-stage steam chamber of the turbine. The process factor is used for calculating a desired temperature of combustion gas in the boiler. Thus the desired temperature of combustion gas in the boiler is calculated not only from the start condition of the boiler but also the start condition of the turbine. Hence the method and system of the present invention can start a thermal power plant more quickly than the conventional method and system.

DETAILED DESCRIPTION OF THE PREFERRED EMBODIMENT

Figure 1:
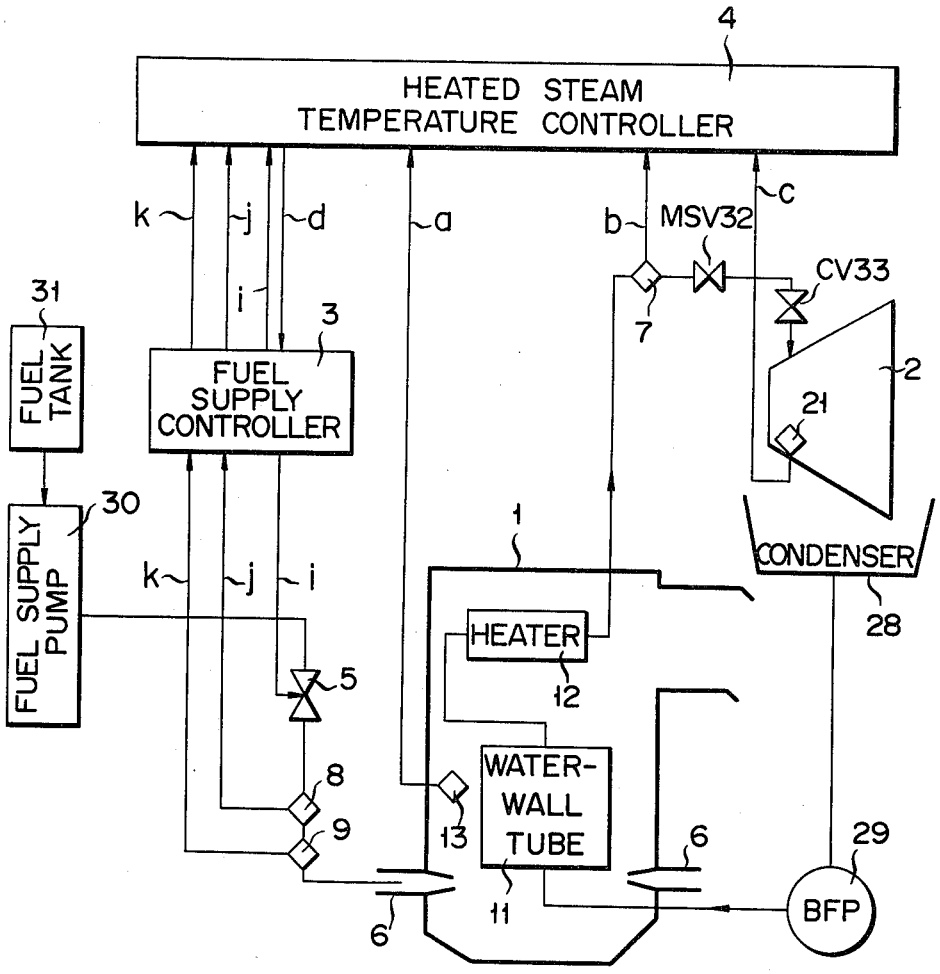
FIG. 1 is a schematic view of an embodiment of the present invention.

FIG. 1 schematically illustrates a system according to the invention for controlling the start of a thermal power plant having a boiler 1 and a turbine 2. The temperature of an inner metal wall of the first-stage steam chamber of the turbine 2 is used as a process factor indicative of the start mode of the turbine.

As shown in FIG. 1, the system comprises a fuel supply controller 3 and a heated steam temperature controller 4. A condenser 28 of the turbine 2 is connected to a water-wall tube 11 of the boiler 1 by means of a pump 29 for supplying water to the boiler 1. After the power plant is made ready to start, burners 6 in the boiler 1 is ignited. The fuel supply from a fuel tank 31 to the boiler 1 through a fuel supply pump 30 is controlled by a control valve 5 according to a fuel supply program under the control of the fuel supply controller 3. The fuel thus supplied to the boiler 1 is burned by the burners 6.

The temperature and pressure of the water flowing through the water-wall tube 11 of the boiler 1 rise, and saturated steam is separated from saturated water in a steam separator (not shown). The saturated steam is supplied to a superheater 12. In the superheater 12 the steam is superheated by the combustion gas in which the heater 12 is placed. When the superheated steam reaches such a temperature that a mismatch temperature falls into a permissible range, it is supplied to the turbine 2 throuth a main stop valve (MSV) 32 and a main steam control valve (CV) 33.

The boiler 1 includes a temperature sensor 13 for detecting the temperature a of combustion gas. In a superheated steam path connecting the superheater 12 to the turbine 2 there is provided a pressure detector 7 for detecting the pressure b of the superheated steam. The turbine 2 includes a sensor 21 for detecting the temperature c of the inner metal wall of the first-stage steam chamber. Data representing the gas temperature a, steam pressure b and metal temperature c are supplied to the steam temperature controller 4. Given these data, the controller 4 calculates a desired gas temperature. From the desired gas temperature thus calculated the controller 4 calculates a process quantity d. The process quantity d is fed to the fuel supply controller 3. According to the process quantity d the controller 3 generates a control signal i to the valve 5. The signal i operates the valve 5, thus controlling the fuel supply to the burners 6.

Figure 2:
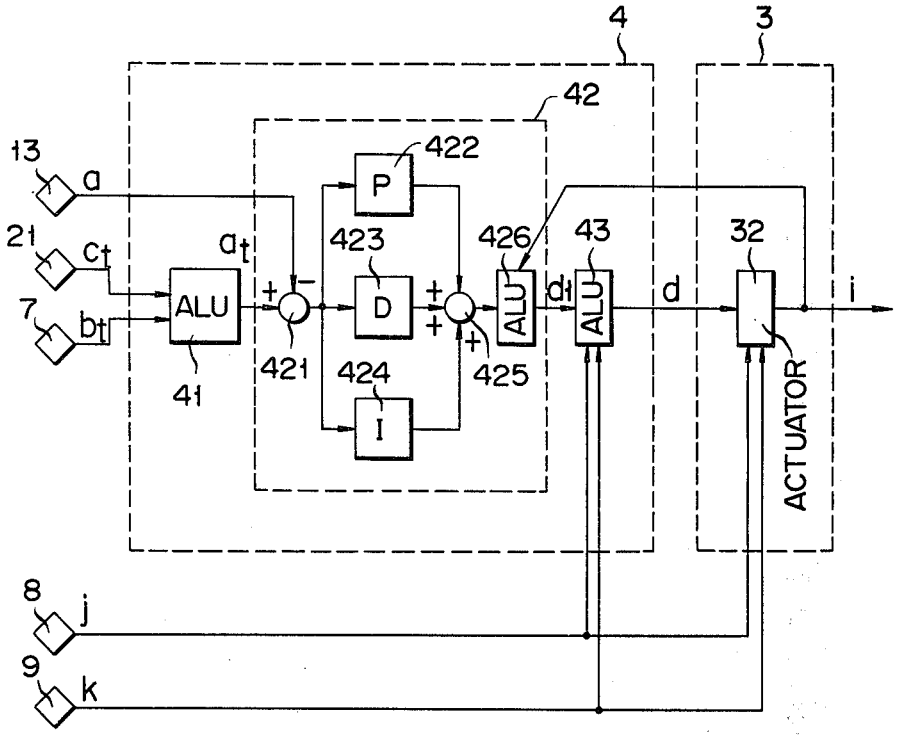
FIG. 2 is a block diagram of a fuel supply controller and a controller for controlling the temperature of superheated steam, both used in the embodiment shown in FIG. 1.
Figure 3:
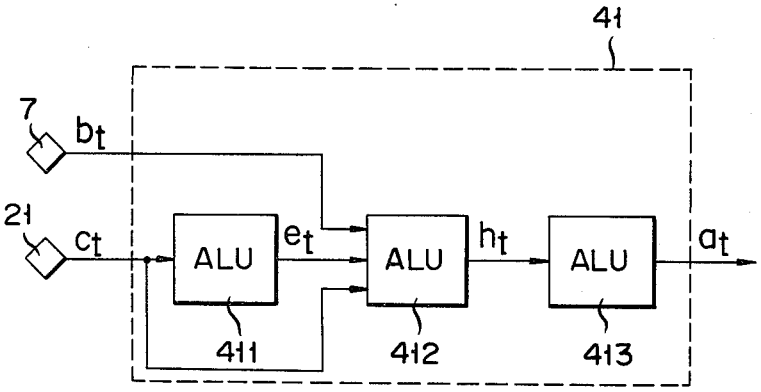
FIG. 3 is a block diagram of a first ALU 41 shown in FIG. 2.

The heated steam temperature controller 4 comprises three ALU sections 41, 42 and 43 as shown in FIG. 2. As shown in FIG. 3, the first ALU section 41 comprises an ALU 411 for calculating a desired mismatch temperature, an ALU 412 for calculating a desired steam temperature and an ALU 413 for calculating a desired gas temperature.

Figure 4:
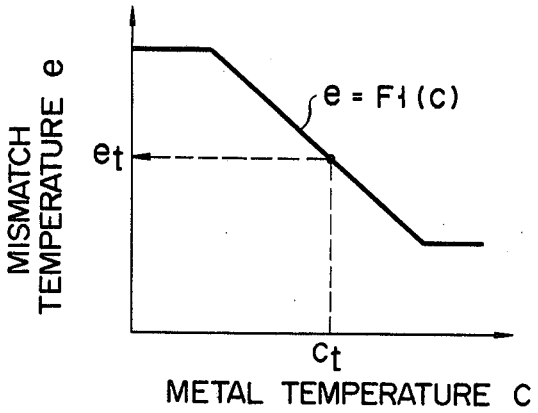
FIG. 4 is a graph illustrating the relationship between the mismatch temperature e and metal temperature c in the embodiment shown in FIG. 1.

The relation between the metal temperature c and the mismatch temperature e is shown in FIG. 4 by a curve, i.e. a desired mismatch temperature curve. The relation is given by: $e=F_1(c)$. The relation is determined by the characteristics of the thermal power plant, the start of which is to be controlled. It is not described here how to determine the relation. The ALU 411 receives data representing a metal temperature $c_t$ detected by the sensor 21 and performs operation $e_t=F_1(c_t)$, thus obtaining a desired mismatch temperature $e_t$. The ALU 411 calculates $F_1(c_t)$ every time it receives a data representing the metal temperature $c_t$. Alternatively, the data representing the mismatch temperature e corresponding to the metal temperature c, which may be experimentally obtained, may be stored in a memory so that the data showing the desired mismatch temperature $e_t$ corresponding to the input metal temperature $c_t$ can be read from the memory.

Figure 5:
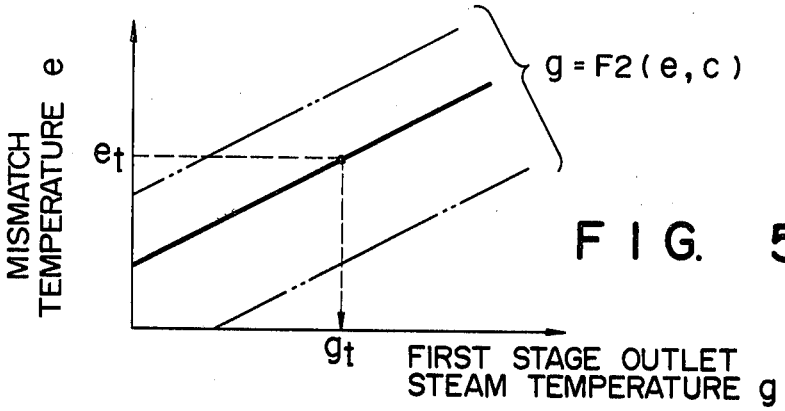
FIG. 5 is a graph showing the relationship between the mismatch temperature e and temperature g of the steam in the first-stage steam outlet.
Figure 6:
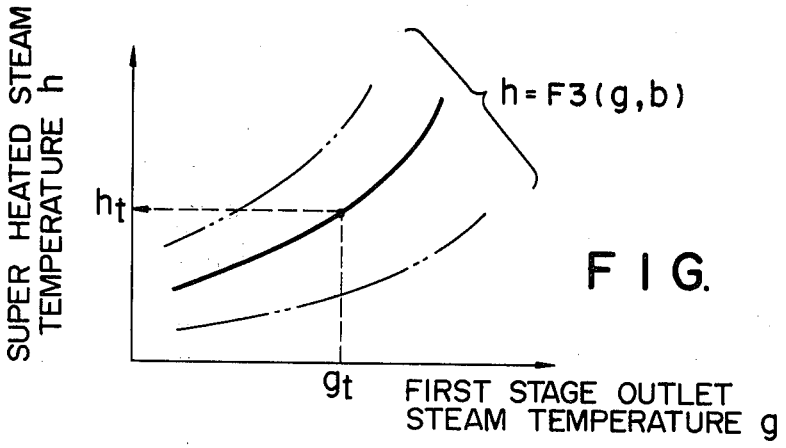
FIG. 6 is a graph illustrating the relationship betwen the temperature g and the temperature h of superheated steam.

The relation between the mismatch temperature e and the temperature g of the steam at the first-stage outlet is given by a curve shown in FIG. 5, using the metal temperature c as a parameter. The relation is: $g=F_2(e, c)$. This relation can be easily determined by the characteristics of the thermal power plant. Thus it is not described here how to determine it. The relation between the temperature g and the temperature h of superheated steam is given by a curve shown in FIG. 6, using the steam pressure b as a parameter. The relation is: $h=F_3(g, b)$. The ALU 412 calculates a desired temperature $g_t$ of the steam at the first-stage outlet, using the pressure b of the superheated steam from superheater 12 and the desired mismatch temperature $e_t$ calculated by the ALU 411, as illustrated in FIG. 5. Then, the ALU 412 calculates a desired temperature $h_t$ of the superheated steam from the desired steam temperature $g_t$ and the pressure $b_t$ of the steam from the boiler 1, as illustrated in FIG. 6.

Figure 7:
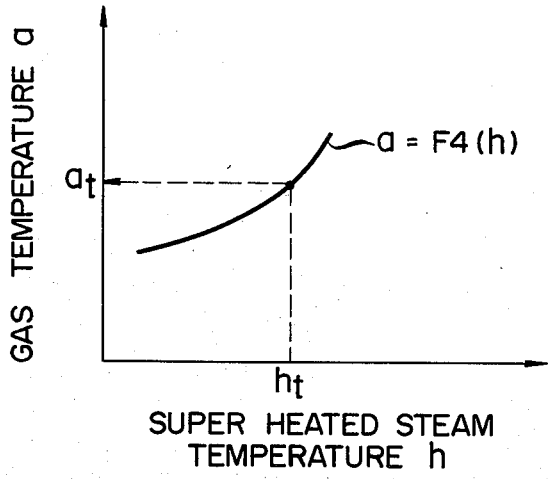
FIG. 7 is a graph illustrating the relationship between the temperature a of combustion gas in the boiler and the temperature h of superheated steam.

The relation between the steam temperature h and the gas temperature a in the boiler 1 is illustrated by a curve shown in FIG. 7. The relation is: $a=F_4(h)$. The relation can be easily determined by the characteristics of the thermal power plant. It is therefore not described here how to determine it. The ALU 413 calculates a desired gas temperature $a_t$ from the desired steam temperature $h_t$ calculated by the ALU 412.

The desired gas temperature $a_t$ thus calculated is fed from the first ALU section 41 to the second ALU section 42. As shown in FIG. 2, the ALU section 42 comprises an adder 421, a proportional unit 422, a differentiator 423, an integrator 424 and another adder 425. The adder 421 receives the data representing the desired gas temperature $a_t$ and the data representing the gas temperature a and calculates the difference between the temperature $a_t$ and the temperature a. The output of the adder 421 is supplied to the proportional unit 422, the differentiator 423 and the integrator 424. PID calculation is performed on the difference between the temperature $a_t$ and the temperature a. The result of the PID calculation is supplied to the adder 425. The results of PID calculation are obvious to one skilled in the art in view of the characteristics of the thermal power plant. No detailed description is thus given of the results. The output of the adder 425 is supplied an ALU 426, which is one element of the ALU section 42. The ALU 426 converts the output of the adder 425 into a process quantity $d_1$. The process quantity $d_1$ is fed to the third ALU section 43. The third ALU 43 converts the process quantity $d_1$ into a process quantity d, which is an output data of the steam temperature controller 4. The third ALU section 43 will later be described in detail.

The process quantity d is supplied to the fuel control valve 5 as a valve opening control signal i through an actuator 32 which includes a motor and other devices. The output i from the actuator 32 is supplied to the ALU 425, which compensates for the delay involved in the operation of a valve drive mechanism (not shown). More specifically, upon receipt of the output i representing the process quantity calculated by the third ALU section 43, the ALU 426 calculates a new process quantity $d_1$ by compensating the output from the adder 425 by a value corresponding to a transfer function. The process quantity $d_1$ thus calculated is supplied to the fuel supply controller 3 through the third ALU section 43 and controls the opening of the VC 5. The VC 5 changes the fuel supply from the fuel tank 31 in such way that the temperature of water flowing through the water-wall tube 11 varies to a desired value. As a result, the gas temperature in the boiler 1 is changed to a desired value.

Since the gas temperature a in the boiler 1 is changed to a desired value, the temperature h of the superheated steam from the superheater 12 is controlled to the desired value, i.e. the temperature which makes mismatch temperature fall into the permissible range.

Hence, superheated steam having a temperature satisfying the start condition of the turbine is supplied to the turbine 2, thus rotating the same. It is therefore possible for the turbine 2 to generate a specified rated output within a short period of time after it starts, without applying an excessive thermal stress on its rotor. The period within which the turbine 2 can start is reduced, in comparison with the period in the conventional system, by the time during which the temperature of the superheated steam is compensated.

All the time the fuel supply is controlled according to the data representing the process quantity d and supplied from the steam temperature controller 4 to the fuel supply controller 3, the process quantity for the boiler 1 must conform to a reference safety value.

As shown in FIG. 1, the system further comprises a fuel supply detector 8 and a fuel pressure detector 9, both at downstream of the CV 5. The detector 8 detects the fuel supply, and the detector 9 the pressure of the fuel. The output data of the detectors 8 and 9, which represent the fuel supply j and the fuel pressure k, are supplied to the third ALU section 43 of the steam temperature controller 4. If the process quantity $d_1$ calculated by the second ALU section 42 deviates from the limits of fuel supply j and fuel pressure k, the third ALU section 43 generates no output data representing the process quantity $d_1$. More precisely, if the fuel pressure k becomes too low to supply fuel to the smallest number of burners 6 which need to keep buring to make the boiler 2 perform is function, the third ALU section 43 generates no data representing the process quantity d for reducing the fuel supply, whereby the burners 6 keep working. If the fuel supply j is smaller than the value necessary for raising the gas temperature to a predetermined value, the third ALU section 43 provides no data representing the process quantity d for reducing the fuel supply. If the fuel supply j conversely surpasses a predetermined value, the third ALU section 43 generates no data showing the process quantity for increasing the fuel supply, thus preventing the heater 12 from being overheated. If the fuel pressure k surpasses a predetermined value, the ALU section 43 generates no data representing the process quantity for increasing the fuel supply, thereby preventing the burners 6 from emitting smoke.

When the third ALU section 43 ceases to generate the process quantity d, the fuel supply controller 3 generates a process signal i according to an operation program of the boiler 1, thereby controlling the fuel supply and thus ensuring the safe operation of the boiler 1.

Figure 8:
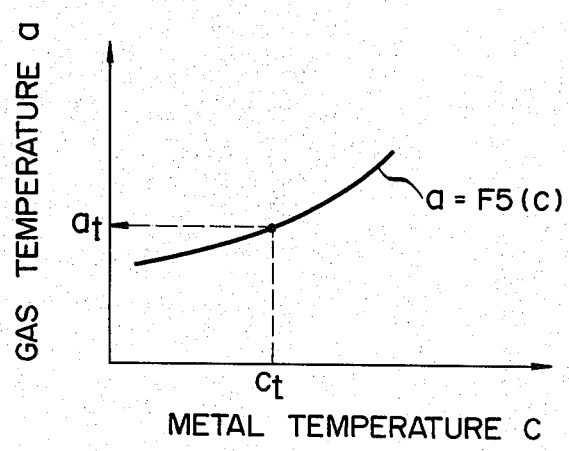
FIG. 8 is a graph showing the relationship between the metal temperature c and the temperature a of combustion gas, which is valid when the superheated steam has a constant pressure.

In the above-described embodiment the gas temperature in the boiler 1 is calculated from the inner metal temperature by means of the calculation sections for calculating a mismatch temperature, a desired steam temperature and a desired gas temperature. This is because the pressure of superheated steam is changed according to the gas temperature in the boiler 1. If the pressure of the superheated steam is kept constant, the gas temperature a is determined solely by the inner metal temperature c because the relationship between these temperatures a and c is, as shown in FIG. 8: $a=F_5(c)$. In this case, the first ALU section 41 can be more simple in structure.

Further, the ALU sections 41, 42 and 43 may be replaced by a digital computer which is installed within the thermal power plant. Alternatively, a special-purpose microcomputer may be used in place of the ALU sections 41, 42 and 43. Use of a digital computer or a special-purpose microcomputer require no accessories and does not make the fuel supply controller 3 more complicated.

What we claim is:

1. A method for controlling the start of a thermal power plant having a turbine, a boiler for generating superheated steam to drive the turbine, a fuel source for supplying fuel to the boiler, a fuel supply controller for controlling the fuel supply from the fuel source to the boiler, and the like, said method comprising the steps of:

supplying fuel from the fuel source to the boiler after the plant has been prepared to start;

igniting burners of the boiler thereby to raise the temperature and pressure of water flowing through water tubes of the boiler;

causing the fuel supply controller to control the fuel supply to the boiler; and starting the supply of superheated steam from the boiler to the turbine when the superheated steam reaches a temperature which satisfies a condition for starting the turbine, said step of causing the fuel supply controller to control the fuel supply including a step of calculating a desired temperature of combustion gas in the boiler from a process factor indicative of the start mode of the turbine, a step of calculating a process quantity of the fuel supply controller from a difference between the desired temperature of combustion gas calculated and the temperature of the combustion gas detected in the boiler, and a step of operating the fuel supply controller according to the process quantity calculated, thereby controlling the fuel supply from the fuel source to the boiler.

2. A method according to claim 1, wherein said step of calculating a desired temperature of combustion gas in the boiler uses as the process factor the temperature of an inner metal wall of a first-stage steam chamber of said turbine.

3. A method according to claim 1, wherein the step of calculating a desired temperature of combustion gas in the boiler includes a step of processing data representing the temperature of an inner metal wall of a first-stage steam chamber of said turbine which is used as said process factor and data representing the pressure of superheated steam in the boiler.

4. A method according to claim 1, wherein said step of calculating a desired temperature of combustion gas in the boiler comprises a step of calculating a mismatch temperature which is a function of the temperature of an inner metal wall of a first-stage steam chamber of the turbine, a step of calculating the temperature of the steam at the first-stage outlet of the turbine which is a function of the mismatch temperature, a step of calculating the temperature of superheated steam from the boiler which is a function of the temperature of the steam at the first-stage outlet of the turbine, and a step of calculating a desired temperature of combustion gas in the boiler which is a function of the temperature of the superheated steam from the boiler.

5. A method according to claim 1, wherein said step of calculating a process quantity of the fuel supply controller includes a step of detecting the fuel supply from the fuel source and the pressure of the fuel from the fuel source and a step of calculating the process quantity according to the fuel supply and fuel pressure thus detected.

6. A system for controlling the start of a thermal power plant having a turbine, a boiler for generating superheated steam to drive the turbine, a fuel source for supplying fuel to the boiler, and the like, said system comprising:

temperature control means for controlling the temperature of superheated steam from the boiler according to the process factor indicative of the start mode of the turbine, thereby to control the fuel supply from the fuel source to the boiler, said temperature control means including means for calculating a desired temperature of combustion gas in the boiler according to the process factor and means for calculating a process quantity for controlling the fuel supply from a difference between the desired temperature of combustion gas and the temperature of the combustion gas in the boiler; and a fuel supply control means for controlling the fuel supply from the fuel source to the boiler according to the process quantity calculated by said temperature control means.

7. A system according to claim 6, wherein said means for calculating a desired temperature of combustion gas in the boiler includes means for detecting the temperature of an inner metal wall of a first-stage steam chamber of the turbine, which is used as a process factor indicative of the start mode of the turbine.

8. A system according to claim 6, wherein said means for calculating a desired temperature of combustion gas in the boiler includes means for detecting the temperature of an inner metal wall of a first-stage steam chamber of the turbine, which is used as a process factor indicative of the start mode of the turbine, and means for detecting the pressure of the superheated steam in the boiler.

9. A system according to claim 6, wherein said means for calculating a desired temperature of combustion gas in the boiler comprises means for calculating a mismatch temperature which is a function of the temperature of an inner metal wall of a first-stage steam chamber of the turbine, means for calculating the temperature of the steam at the first-stage outlet of the turbine which is a function of the mismatch temperature, means for calculating the temperature of superheated steam from the boiler which is a function of the temperature of the steam at the first-stage outlet of the turbine, and means for calculating a desired temperature of combustion gas in the boiler which is a function of the temperature of the superheated steam from the boiler.

10. A system according to claim 6, wherein said fuel supply control means includes means for detecting the fuel supply from said fuel source to said boiler, means for detecting the pressure of the fuel supplied from said fuel source to said boiler, and means for calculating said process quantity according to the fuel supply and fuel pressure thus detected.

* * * * *